United States Patent [19]

Schloemann

[11] Patent Number: 4,575,695

[45] Date of Patent: Mar. 11, 1986

[54] METHOD AND APPARATUS FOR ORIENTATING FERRIMAGNETIC BODIES

[75] Inventor: Ernst F. R. A. Schloemann, Weston, Mass.

[73] Assignee: Raytheon Company, Lexington, Mass.

[21] Appl. No.: 446,533

[22] Filed: Dec. 3, 1982

[51] Int. Cl.[4] ..... H01P 1/30; H01P 1/32

[52] U.S. Cl. ..... 333/24.1; 148/108; 324/232; 335/284; 333/234; 333/205

[58] Field of Search ..... 333/24.1, 202, 205, 333/234; 335/284; 324/202, 232, 246, 260–262; 29/602 R; 148/108

[56] References Cited

U.S. PATENT DOCUMENTS

| | | | |
|---|---|---|---|
| 3,067,140 | 12/1962 | Davis, Jr. | 148/108 UX |
| 3,246,263 | 4/1966 | Clark | 333/24.1 |
| 3,839,677 | 10/1974 | Sedin | 333/202 X |
| 3,924,211 | 12/1975 | Ioffe et al. | 335/284 |

FOREIGN PATENT DOCUMENTS

| | | | |
|---|---|---|---|
| 5560 | 2/1973 | Japan | 148/108 |
| 721309 | 1/1955 | United Kingdom | 333/24.1 |

*Primary Examiner*—Paul Gensler

*Attorney, Agent, or Firm*—Denis G. Maloney; Richard M. Sharkansky

[57] ABSTRACT

An apparatus and method for selectively orientating a ferrimagnetic body along a selected temperature invariant crystallographic axis includes a first pair of coils disposed for producing a magnetic field along a first direction, and a second pair of coils disposed within the first pair of coils for producing a magnetic field along a second direction, the direction of such second field being displaced at a predetermined angle $\theta$, with respect to the direction of said first field. A platform upon which the ferrimagnetic body is supported is disposed at an intersection of such fields and has a surface disposed at a predetermined direction with respect to a horizontal plane. A series of alternate pulsed magnetic fields is generated in turn by each pair of coils and the body rotates in response to each one of such fields. After pulsed fields have been generated, the so-called "easy axis" of the crystallographic structure of the body is aligned with the axis of the coils. A suitable member is then attached to said body at a predetermined bias direction determined by the directional displacement of an upper portion of the platform. Thus, the rotation of the ferrimagnetic body by the magnetic fields in combination with the calibrated attachment of the member to the ferrimagnetic body at the predetermined bias angle provides a ferrimagnetic body orientated along a temperature invarient crystallographic axis.

22 Claims, 6 Drawing Figures

METHOD AND APPARATUS FOR ORIENTATING FERRIMAGNETIC BODIES

BACKGROUND OF THE INVENTION

This invention relates generally to tuned radio frequency (r.f.) circuits and more particularly to tunable r.f. resonant circuits.

As is known in the art, tunable resonant circuits are often used in receiver applications, such as in a radar receiver system to filter out unwanted frequency components of a signal fed thereto. In particular, bandpass filters having a narrow frequency passband are often used as microwave filters. One approach used in the art to provide a tunable r.f. filter is the use of a resonant circuit including a pair of coupling circuits connected to input and output ports with a ferrimagnetic body disposed adjacent thereto. A YIG sphere is often used as the ferrimagnetic body. The principal of operation with using a YIG sphere as the ferrimagnetic material is that, in the presence of an applied D.C. magnetic field $H_{DC}$, the YIG sphere of such material will provide a resonant circuit having a resonant frequency ($\omega_o$) given as $\omega_o=\gamma H_{DC}$ where $\gamma$ is a quantity referred to as the gyromagnetic ratio. When input energy is fed to an input one of such coupling circuits, a portion of such energy having a frequency substantially equal to the resonant frequency $\omega_o$ is coupled to an output one of such coupling circuits. One problem as known in the prior art is that the resonant frequency of the resonant body in general is a strong function of variations in temperature and thus over the operating temperature range of such resonant circuit such resonant frequency will change. However, in certain orientations of the YIG sphere with respect to the applied d.c. magnetic field $H_{DC}$, the resonant frequency of the YIG sphere is independent of variations in temperature over a wide range of operating temperatures. Thus, when fabricating filters using ferrimagnetic bodies, it is most desirable to use an oriented ferrimagnetic body. In some prior art coupling structures, such as a pair of orthogonally spaced semicircular conductors, it is often required to partially orientate a YIG sphere along an easy axis of the sphere's crystallographic structure, and to complete orientation of the sphere within the presence of such coupling loops to compensate for the spatial uncertainty of the coupling circuits, with respect to the ferrimagnetic body. However, in other applications such as filters employing planar coupling structures where there is no spatial uncertainty between the coupling circuits and the ferrimagnetic body, it is desirable to provide a YIG sphere which is in its final oriented alignment. This is because in order to fully exploit the advantages of high reproducibility and ease of construction generally associated with planar coupling structures, a ferrimagnetic body aligned about its final orientation with respect to a d.c. magnetic field is required in order to minimize additional costly alignment and fabrication steps after assembly of the filter. Thus, in such a case an apparatus and method for aligning a ferrimagnetic body about its final orientation is required.

SUMMARY OF THE INVENTION

In accordance with the present invention, an apparatus and method for selectively orientating a ferrimagnetic body along a predetermined crystallographic axis includes a first pair of coils disposed for producing a magnetic field along a first direction, and a second pair of coils disposed within the first pair of coils for producing a magnetic field along a second direction, such field being displaced at a predetermined angle $\theta$, with respect to the direction of said first field. A platform upon which the ferrimagnetic body is supported is disposed at a predetermined intersection of the axis of each of such coils. The platform includes a surface displaced, a predetermined direction from a horizontal plane and a low friction surface, such as a watch jewel having a recessed portion embedded in the surface. An individual member having an aperture therein is disposed in the support with such aperture being aligned with the recessed portion of the watch jewel. The body is disposed in the recessed portion of the watch jewel and through the aperture in the inclined member. A series of alternate pulsed magnetic fields are generated in turn by each pair of coils and the body rotates in response to each one of such fields. In response to the magnetic fields, the ferrimagnetic body is rotated such that two of its easy axes are aligned along the axes of the coils. A suitable member is then attached to said body along a predetermined direction. The direction of attachment of the suitable member to the sphere is determined by the orientation of the inclined member supported on the support, with respect to the axis of each of such coils. With such an arrangement, the rotation of the ferrimagnetic body by the magnetic fields in combination with the calibrated attachment of the member to the body provides a ferrimagnetic body oriented along a temperature invariant crystallographic axis. Thus, a ferrimagnetic body oriented about its final crystallographic orientation is provided without the iterative alignment steps generally associated with the prior art.

BRIEF DESCRIPTION OF THE DRAWINGS

The foregoing features of the invention, as well as the invention itself, may be more fully understood from the following detailed description read together with the accompanying drawings in which.

DESCRIPTION OF THE PREFERRED EMBODIMENT

Figure 1:
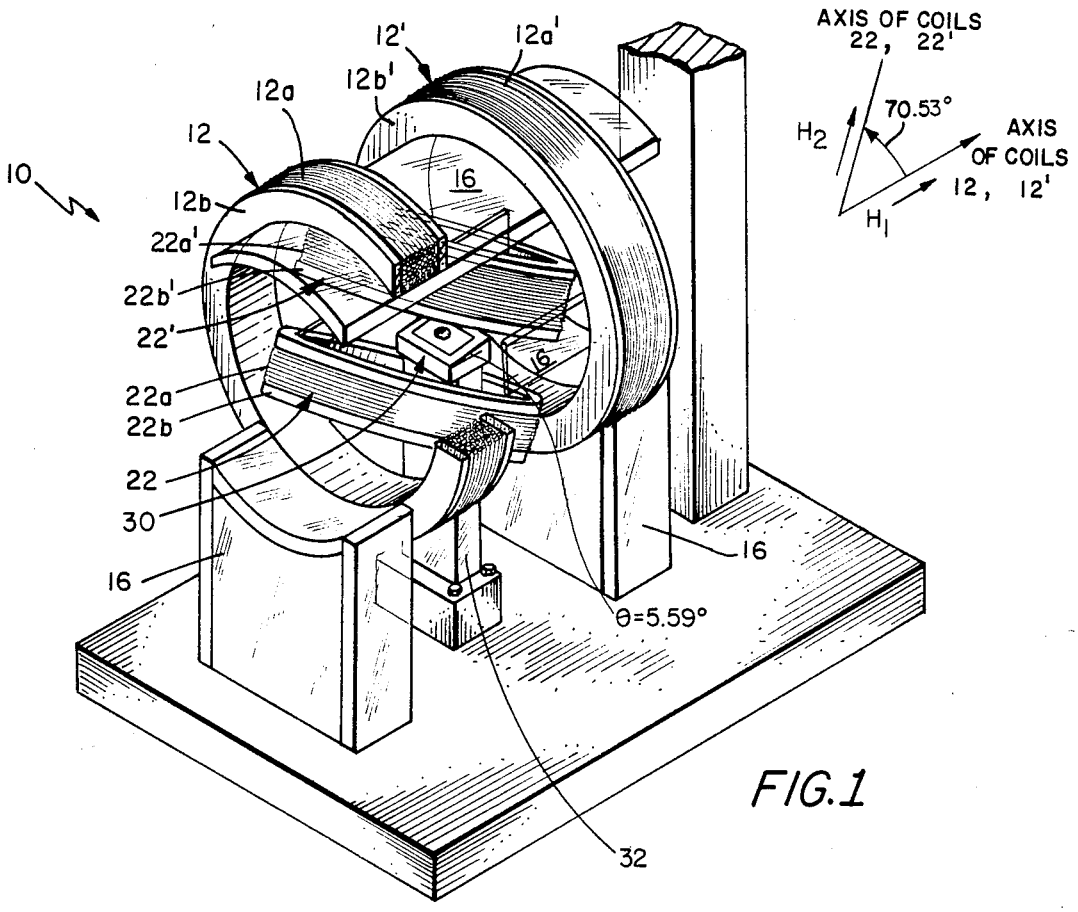
FIG. 1 is an isometric view partially broken away, of an apparatus for orientating YIG spheres.
Figure 5:
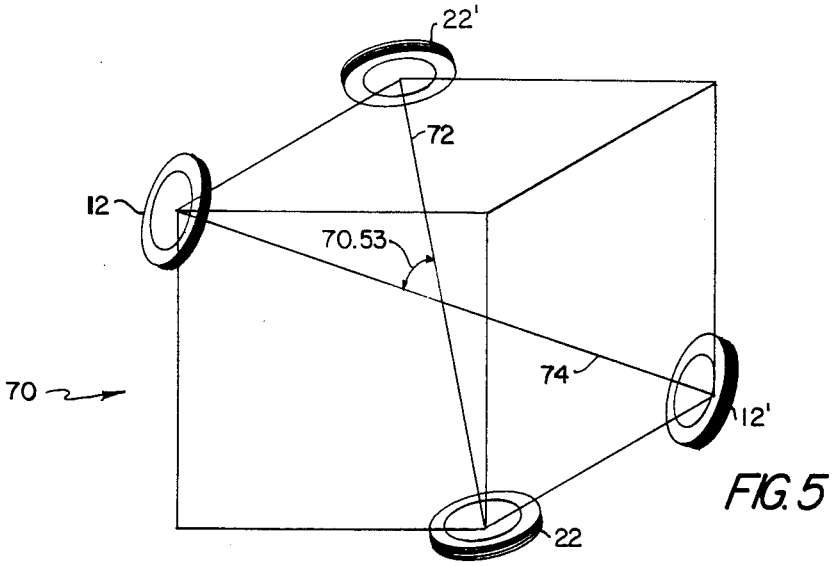
FIG. 5 is an isometric view of a cube depicting the relationship of a pair of coplanar body diagonals thereof to the axes of the coils shown in FIG. 1.

Referring now to FIG. 1, an apparatus 10 for orientating a ferrimagnetic sphere along a predetermined crystallographic direction includes a first pair of coils 12, 12' here including wire conductors **12*a*, 12*a'* wound around plastic cores 12*b*, 12*b'*. Coils 12, 12' are arranged in a corresponding plastic support 16 (partially shown). Coils 12, 12' provide a magnetic field $H_1$ of here 1000 gauss in a horizontal or Y direction, as shown. The apparatus 10 also includes a second pair of coils 22, 22' here including wire conductors 22*a*, 22*a'* wound around plastic cores 22*b*, 22*b'*. Coils 22, 22' are arranged on the plastic support 16 and are disposed within the region confined by the first pair of coils 12, 12'. The axis of such coils 22, 22' are disposed at an angle $\theta$ of here 70.53° with respect to the axis of the first pair of coils 12, 12', as shown. Coils 22, 22' provide a second magnetic field $H_2$ of here 1000 gauss. The apparatus further includes a platform 30 centrally disposed between such pairs of coils 12, 12', 22, 22', as shown. Each pair of coils 12, 12', 22, 22' are arranged in such a way as to provide a magnetic field between each of such pair of coils having directions which correspond to a pair of coplanar body diagonals 72, 74 of a cube 70, as shown in FIG. 5**.

Figure 2:
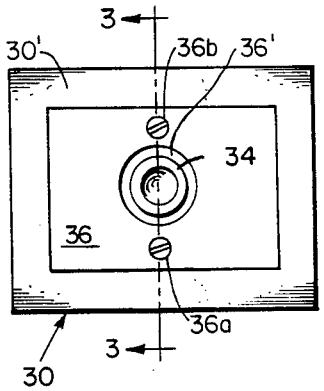
FIG. 2 is a plan view of a platform portion of the apparatus shown in FIG. 1.
Figure 3:
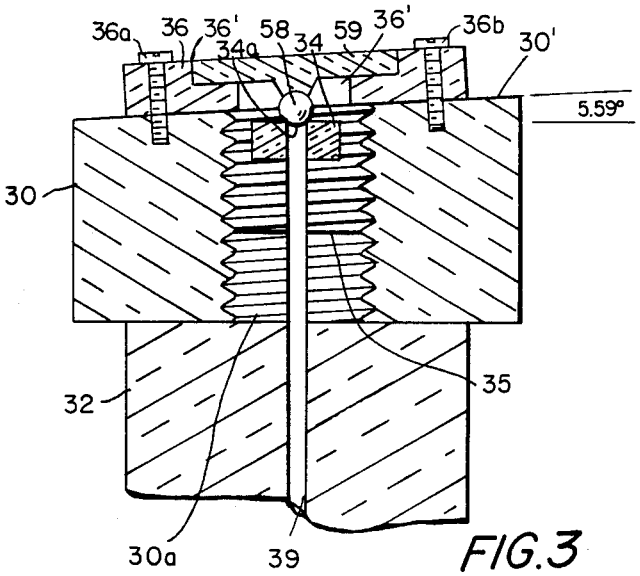
FIG. 3 is a cross-sectional view taken along line 3—3 of the platform shown in FIG. 2.

Referring now to FIGS. 2 and 3, the platform 30 here of Lucite (Dupont Co.) is supported by a support rod 32 here of Lucite (Dupont Co.) having a first surface 30' here opposite the support rod 32 disposed at a predetermined direction with respect to the horizontal plane of the apparatus 10. Here the surface is inclined at an angle $\phi$ here 5.59° with respect to the horizontal direction. A threaded aperture **30*a* is provided in the platform 30 and a nylon screw 35 is threaded therein. The nylon screw 35 is inserted normal to the horizontal direction and has an upper portion wherein is embedded a watch jewel 34 here of sapphire. The watch jewel 34 has a recessed portion 34*a* to support a YIG sphere 58. The nylon screw 35 is provided to adjust the position of the YIG sphere 58, to accommodate the apparatus for here a variety of YIG spheres of various diameters. As shown in FIG. 3, the screw 35 and watch jewel 34 have an aperture 39 therein for applying a small negative pressure to hold the YIG sphere in the recess 34*a*. A cover member 36 having an aperture 36' corresponding in size and shape to a YIG sphere support 59 (FIG. 4, 4A) is then fastened with screws 36*a* and 36*b* to the platform 30 along the inclined surface portion 30' thereof. The apparatus is here used to orientate the sphere 58 as follows: a negative pressure is initially applied through aperture 39 to insure that YIG sphere 58 is properly disposed in the recessed portion 34*a* of watch jewel 34; the negative pressure is then removed; a series of pulses of current from a current means (not shown) are alternatively applied to each coil of such pairs of coils 12, 12', 22, 22', in turn, at intervals of here one pulse every 20 seconds, with such pulse having a pulse width of approximately 100 ms; in response to each pulse of current to each pair of coils 12, 12', 22, 22' a magnetic field $H_1$, $H_2$ is generated, in turn, between each pair of coils and the YIG sphere 58 rotates in response to each of such fields tending to align itself such that a pair of coplanar body diagonals 72, 74 of the sphere's crystallographic structure (represented by cube 70 (FIG. 5)) are parallel with the directions of the fields $H_1$, $H_2$; after approximately five to six minutes of alternate pulsing of each pair of such coils, the YIG sphere 58 is orientated such that the magnetic fields $H_1$, $H_2$ are aligned with one of the "easy axis" of the sphere's structure. Temperature invariant orientation of the YIG sphere 58 is provided when the sphere support 59 is brought into contact with the sphere 58, since the sphere support 59 is brought into contact with the sphere 58 normal to the inclined surface 30' and at the bias angle $\phi$ with respect to the vertical axis of the sphere ($\phi$ is equal to the incline of the platform surface 30'). Thus, the YIG sphere 58 is orientated about a temperature invariant axis with respect to the direction of engagement of the YIG sphere support 59 with the YIG sphere 58, since the YIG sphere support engages the YIG sphere at an angle of 5.59° removed from the vertical axis of the sphere 58. Initial alignment of the sphere so that the easy axes of the sphere crystallographic structure are aligned with the axes of the coils in combination with a calibrated attachment of the sphere support 59 at a predetermined direction with respect to the vertical direction of the initially aligned sphere 58 on the axes of the coils, provides a sphere orientated about a temperature invariant axis. In order to check orientation, several methods may be used including X-ray diffraction analysis as known in the art, or by testing performance of such sphere in a magnetic tuned resonant circuit such as a filter to be described in conjunction with FIGS. 4, 4A**.

Figure 4:
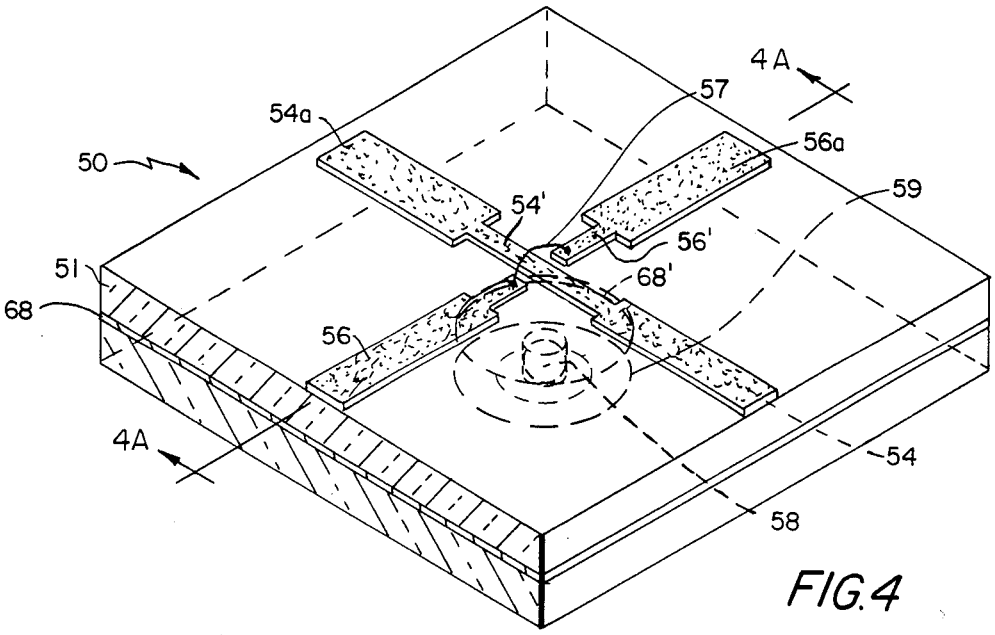
FIG. 4 is an isometric view of a YIG filter wherein an orientated YIG sphere in accordance with the invention is disposed.
Figure 4A:
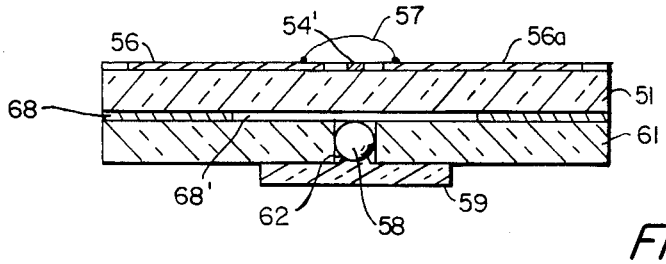
FIG. 4A is a cross-sectional view of FIG. 4 taken along line 4A—4A.

Referring now to FIGS. 4, 4A, a bandpass filter 50 wherein the orientated YIG sphere 58 is disposed includes a dielectric substrate 51 supporting a first strip conductor 54 which is coupled to a corresponding quarter wavelength stub **54*a* (terminated in an open circuit) via a thinner portion 54' of strip conductor 54, and a second strip conductor 56 which is coupled to a corresponding quarter wavelength stub 56*a* (terminated in an open circuit), via a thinner portion 56' of strip conductor 56 and a conductor 57 which crosses or bridges over conductor 54' and is dielectrically spaced therefrom. The quarter wavelength stubs 54*a*, 56*a* here provide short circuits at the center of such conductors 54', 57 to maximize the magnetic field at such point, as is well-known in the art. Here a bonding wire is shown as conductor 57, but a plated overlay as known in the art may alternatively be used. On a surface of substrate 51 opposite the surface supporting the strip conductors 54, 56 is provided a ground plane conductor 68. A void 68' is provided in the ground plane conductor 68 exposing an underlying portion of the dielectric substrate 51. A second dielectric substrate 61 having an aperture 62 is joined with the ground plane conductor 68 and aligned with void 68'. The YIG sphere 58 attached to the support 59 is then disposed in the aperture 62** and held therein with a suitable low loss epoxy.

Having described preferred embodiments of the invention, it will now be apparent to one of skill in the art that other embodiments incorporating its concept may be used. It is believed, therefore, that this invention should not be restricted to the disclosed embodiments, but rather should be limited only by the spirit and scope of the appended claims.

What is claimed is:

1. A method for orientating a magnetic resonant body comprising the steps of:

generating a first magnetic field along a first direction during first intervals of time;

generating a second magnetic field along a second direction, during second, different intervals of time;

positioning the magnetic resonant body within the influence of each one of said fields; and attaching a support member comprising a non-magnetic material to said magnetic resonant body at a predetermined bias angle with respect to the direction of one of said fields after a predetermined number of said first and second intervals of time to align a selected crystallographic axis of the magnetic resonant body along the support member.

2. The method of claim 1 wherein said first and second directions are separated by an angular difference equal to 70.53° and said bias angle is 5.59° with respect to a first one of said first and second directions.

3. The method of claim 2 wherein a first one of said first and second directions is disposed in a horizontal plane, the second one of said first and second directions is disposed at an angular displacement of 70.53° therefrom, and said bias angle is 5.59° from the direction of said horizontal plane.

4. The method of claim 1 wherein said magnetic resonant body has a crystal structure, and said positioning step further comprises the step of: aligning a pair of coplanar body diagonals of the crystal structure of said magnetic resonant body along the pair of directions of the first and second magnetic fields.

5. The method of claim 4 wherein during said positioning step the magnetic resonant body is supported within the influence of each one of said fields by supporting said magnetic resonant body on a low friction surface.

6. The method of claim 5 wherein said magnetic body comprises a sphere of yttrium iron garnet and wherein during said attaching step the member is attached to said sphere which was aligned with respect to an easy axis of said sphere during the positioning step to provide the sphere aligned with respect to a temperature invariant axis of said sphere.

7. The method of claim 5 wherein said low friction surface is disposed adjacent an inclined surface, an angular displacement of said inclined surface being related to said bias angle and wherein during said attaching step the member is attached to said magnetic resonant body at the bias angle related to the angular displacement of said inclined surface.

8. The method of claim 7 wherein said first and second directions are separated by an angular difference equal to 70.53° and said bias angle is 5.59° with respect to a first one of said first and second directions.

9. The method of claim 8 wherein a first one of said first and second directions is disposed in a horizontal plane, the second one of said first and second directions is disposed at an angular displacement of 70.53° therefrom, and said bias angle is 5.59° from the direction of said horizontal plane.

10. A method comprising the steps of:

disposing a first set of coils along a first predetermined axis;

disposing a second set of coils along a second predetermined axis and at a predetermined bias with respect to said first axis;

positioning a magnetic resonant body between said coils;

generating alternate magnetic fields from corresponding ones of said coils; and applying a non-magnetic support member to said magnetic resonant body at a predetermined bias angle with respect to one of said fields to align a temperature invariant axis of said magnetic resonant body along an axial direction of the support member.

11. The method of claim 10 wherein said predetermined bias of said second direction with respect to said first direction is equal to 70.53° and said predetermined bias angle is 5.59°.

12. The method of claim 11 wherein the first axis is disposed in a horizontal plane, the predetermined bias of the second axis is 70.53° and said bias angle is displaced 5.59° from said horizontal plane.

13. The method of claim 10 wherein during said generating step the alternating magnetic fields cause the magnetic body to move in response to said alternating fields to align an easy axis direction of said body along one of the axes directions of said first and second sets of coils.

14. The method of claim 13 wherein said positioning step further comprises the step of supporting said magnetic resonant body between said coils at the intersection of the axial directions of the fields generated by said coils.

15. The method of claim 14 wherein said magnetic body comprises a sphere of yttrium iron garnet and wherein during said applying step the member is attached to the sphere which was aligned with respect to an easy axis of said sphere during the generating step to provide the sphere attached to the member and aligned with respect to a temperature invariant axis of the sphere.

16. The method of claim 15 wherein the sphere is supported on a substantially low friction surface, and has an inclined surface adjacent said low friction surface which is disposed at an angle related to said bias angle.

17. The method of claim 16 wherein said predetermined bias of said second direction with respect to said first direction is equal to 70.53° and said predetermined bias angle is 5.59°.

18. The method of claim 17 wherein the first axis is disposed in a horizontal plane, the predetermined bias of the second axis is 70.53°, and said bias angle is displaced 5.59° from said horizontal plane.

19. In combination:

first means for generating a first magnetic field along a first predetermined direction;

second means for generating a second magnetic field along a second different predetermined direction;

a magnetic resonant body disposed at an intersection of such fields;

means for supporting the magnetic resonant body at the intersection of said fields; and means including an inclined surface disposed at a predetermined angle with respect to one of the directions of said fields for displacing at said angle a non-magnetic support member which is brought into contact with said magnetic resonant body to align a temperature invariant axis of the magnetic resonant body along an axial direction of the support member.

20. The combination of claim 19 wherein said first means for generating a first magnetic field along a first predetermined direction comprises a pair of coils axially disposed along said first predetermined direction, said second means for generating a second magnetic field along a second different predetermined direction comprises a second pair of coils axially disposed along said second predetermined direction and wherein said first pair of coils are disposed within the influence of said second pair of coils.

21. The combination of claim 18 wherein said first and second directions are separated by an angular displacement of 70.53° and said inclined surface is disposed at the predetermined angle of 5.59° with respect to one of said first and second directions.

22. The combination of claim 21 wherein a first one of said first and second directions is disposed in a horizontal plane, the second one of said first and second directions is disposed at an angular displacement of 70.53° therefrom, and said predetermined angle is displaced 5.59° from the direction of said horizontal plane.

* * * * *